US010435196B2

(12) United States Patent
Uematsu

(10) Patent No.: US 10,435,196 B2
(45) Date of Patent: Oct. 8, 2019

(54) RECEIVING CONTAINER

(71) Applicant: TEIKOKU SEIYAKU CO., LTD., Kagawa (JP)

(72) Inventor: Masanori Uematsu, Kagawa (JP)

(73) Assignee: TEIKOKU SEIYAKU CO., LTD., Kagawa (JP)

( * ) Notice: Subject to any disclaimer, the term of this patent is extended or adjusted under 35 U.S.C. 154(b) by 0 days.

(21) Appl. No.: 15/753,842

(22) PCT Filed: Jun. 22, 2016

(86) PCT No.: PCT/JP2016/068482
§ 371 (c)(1),
(2) Date: Feb. 20, 2018

(87) PCT Pub. No.: WO2017/029879
PCT Pub. Date: Feb. 23, 2017

(65) Prior Publication Data

US 2019/0009945 A1 Jan. 10, 2019

(30) Foreign Application Priority Data

Aug. 19, 2015 (JP) ..... 2015-161721

(51) Int. Cl.
*B65D 5/46* (2006.01)
*B65D 5/54* (2006.01)
(Continued)

(52) U.S. Cl.
CPC ..... *B65D 5/46024* (2013.01); *B65D 5/0227* (2013.01); *B65D 5/541* (2013.01); *B65D 5/6602* (2013.01)

(58) Field of Classification Search
CPC ..... B65D 5/46024; B65D 5/46008; B65D 5/541; B65D 5/0227; B65D 5/6602
See application file for complete search history.

(56) References Cited

U.S. PATENT DOCUMENTS 4,498,620 A 2/1985 Dickert et al.
5,106,015 A 4/1992 Vlasaty et al.
(Continued)

FOREIGN PATENT DOCUMENTS

AT 399 701 7/1995
DE 40 37 000 5/1992
(Continued)

OTHER PUBLICATIONS

Extended European Search Report dated Dec. 13, 2018 in corresponding European Patent Application No. 16836871.0.
(Continued)

*Primary Examiner* — Justin M Larson
(74) *Attorney, Agent, or Firm* — Wenderoth, Lind & Ponack, L.L.P.

(57) ABSTRACT

A receiving container includes a container body and a grip member. The container body includes: a body portion in a hollow tubular shape; a bottom portion configured to close one end side opening portion of the body portion; and a ceiling portion configured to close another end side opening portion of the body portion. One of a first extending portion and a second extending portion of the ceiling portion has a separation portion configured to separate a tip portion. The grip member includes: attachment portions, and a grip portion grippable by hand. The attachment portions are configured to prevent the first extending portion and the second extending portion from opening from the other end side opening portion. The attachment portions are attached to a tip side of the separation portion in either of the first or second extending portion provided with the separation portion.

6 Claims, 6 Drawing Sheets

(51) Int. Cl.
*B65D 5/02* (2006.01)
*B65D 5/66* (2006.01)

(56) References Cited

U.S. PATENT DOCUMENTS

| | | | | |
|---|---|---|---|---|
| 7,441,693 | B2 * | 10/2008 | Liao | B65D 5/46024 229/117.19 |
| D820,078 | S * | 6/2018 | Uematsu | D9/416 |
| 2005/0139626 | A1 * | 6/2005 | Owens | B65D 5/46024 225/1 |
| 2007/0175970 | A1 * | 8/2007 | Liao | B65D 5/46024 229/117.19 |
| 2018/0170610 | A1 * | 6/2018 | Buss | B65D 5/6661 |

FOREIGN PATENT DOCUMENTS

| | | |
|---|---|---|
| JP | 63-86014 | 6/1988 |
| JP | 1-76408 | 5/1989 |
| JP | 5-34186 | 5/1993 |
| JP | 7-8213 | 2/1995 |
| JP | 2013-177152 | 9/2013 |

OTHER PUBLICATIONS

International Search Report dated Sep. 13, 2016 in International (PCT) Application No. PCT/JP2016/068482.

* cited by examiner

RECEIVING CONTAINER

TECHNICAL FIELD

The present invention relates to a receiving container.

BACKGROUND ART

A publicly known packaging box includes an inner lid connected to one of opposite sides of an opening edge of a box body, and an upper lid connected to the other side. The packaging box is deformed to be brought into a closed state by inserting an insertion piece of the upper lid into an insertion hole of the inner lid. The packaging box is not allowed to be opened without separation of an opening means formed in the upper lid (see, for example, Japanese Patent Laid-open Publication No. 2013-177152).

However, the conventional packaging box is not manufactured on the premise of portability, merely not needing gluing at the time of packing, and the trace of opening can only be clearly recognized visually.

It is an object of the present invention to provide a receiving container that not only can be easily packed and can leave traces of opening, but also is easy to carry.

SUMMARY OF THE INVENTION

In order to achieve the above object, the present invention provides a receiving container that includes: a container body including: a body portion in a hollow tubular shape; a bottom portion configured to close one end side opening portion of the body portion; and a ceiling portion configured to close another end side opening portion of the body portion, the ceiling portion having a first extending portion and a second extending portion each of which extends from an edge of the other end side opening portion and one of which is provided with a separation portion configured to separate a tip portion; and a grip member including: attachment portions attached to the first extending portion and the second extending portion, configured to prevent the first extending portion and the second extending portion from opening from the other end side opening portion, and attached to a tip side of the separation portion in the first or second extending portion provided with the separation portion; and a grip portion grippable by hand.

With this configuration, simply closing the other end side opening portion of the container body with the first extending portion and the second extending portion and attaching the grip member thereto prevent the container body from opening without being separated with the separation portion. That is, traces of opening can be reliably left. In addition, the grip member is attached to the first extending portion and the second extending portion, so that the attaching state can be strengthened. Therefore, gripping the grip portion allows the container body to be easily carried in a stable state.

Preferably, first through holes are formed in the first extending portion, second through holes are formed in the second extending portion at positions corresponding to the first through holes with the second extending portion overlapping with the first extending portion on an outer surface side, and the attachment portions are inserted in the first through holes via the second through holes to be prevented from coming off.

With this configuration, with a simple configuration where through holes are merely formed in the respective extending portions, inserting the attachment portions of the grip member in these through holes to prevent them from coming off allows the other end side opening portion of the container body to be in a closed state.

Preferably, the other end side opening portion of the body portion has a rectangular shape, the first extending portion is an inner lid extending from one side of a pair of opposite sides in the other end side opening portion and configured to close the other end side opening portion, and the second extending portion is an upper lid extending from another side of the pair of opposite sides in the other end side opening portion and configured to cover at least a part of the first extending portion.

With this configuration, with the other end side opening portion of the container body closed with the first extending portion serving as the inner lid, covering a part of the other end side opening portion with the second extending portion serving as the upper lid, and attaching the attachment portions of the grip member allow the container body to be in a closed state.

Preferably, the first through holes include first straight portions formed in parallel at a predetermined interval and second straight portions formed to intersect the respective first straight portions, and the respective attachment portions extend from both end portions of the grip portion to both sides and are inserted in the first straight portions of the first through holes to be prevented from coming off.

With this configuration, attempting to insert the attachment portions of the grip portion into the first straight portions makes it easier for the second straight portions to deform the peripheral parts constituting the first straight portions. Thus, the attachment portions can be easily inserted into the first through holes, and the grip member can be easily attached. In particular, since the first extending portion is covered with the second extending portion, the ease of inserting the attachment portions into the first through holes is important.

Preferably, the container body is made of corrugated cardboard, and in the first extending portion, predetermined regions including the first through holes have thin-walled portions thinner than other portions.

With this configuration, since a gap is hardly formed between liners on front and back surfaces constituting the corrugated cardboard due to the thin-walled portion, when the attachment portions of the grip member are inserted into the first through holes, the attachment portions do not enter between the liners, and there is no possibility of causing poor attachment.

Preferably, the container body includes auxiliary extending portions extending from sides of a remaining pair of the opposite sides in the other end side opening portion.

With this configuration, when the other end side opening portion of the container body is closed with the first extending portion, the auxiliary extending portions prevent the first extending portion from falling into the container body, and a good closed state with the first extending portion can be obtained. In addition, the auxiliary extending portions close a gap with the first extending portion leading into the container body.

Preferably, the auxiliary extending portions are connected to the container body via a folding line portion, bend at a predetermined angle to the container body by the folding line portion when a bending force acts toward inside, and bend to a closing position when the other end side opening portion of the container body is closed with the first extending portion.

With this configuration, when the auxiliary extending portions are bent inward at a predetermined angle in advance by using the folding line portion, only closing the other end side opening portion of the container body with the first extending portion allows the auxiliary extending portions to be bent inward at the same time. Therefore, closing with the extending portion can be performed with good workability.

Effects of the Invention

According to the present invention, in order to keep the other end side opening portion of the container body in a closed state, the attachment portions of the grip member provided separately may be attached to the first extending portion and the second extending portion. Since the attachment portions are attached not only to the first extending portion but also to the second extending portion, the attachment state can be strengthened. Then, gripping the grip portion of the grip member allows the container body to be easily carried in a stable state. In the case of opening, the separation portion needs to be separated, and a trace of opening can be left.

EMBODIMENTS OF THE INVENTION

In the following, an embodiment according to the present invention will be described with reference to the accompanying drawings. It should be noted that in the following description, terms indicating specific directions and positions (for example, terms including "upper", "lower", "side", and "end") are used as necessary, but using these terms is to facilitate understanding of the invention with reference to the drawings, and the technical scope of the present invention is not limited by the meaning of the terms. In addition, the following description is, fundamentally, merely illustrative and is not intended to limit the present invention, products to which the present invention is applied, or applications of the present invention. Furthermore, the drawings are schematic, and the ratio and the like of each dimension are different from actual ones.

Figure 1:
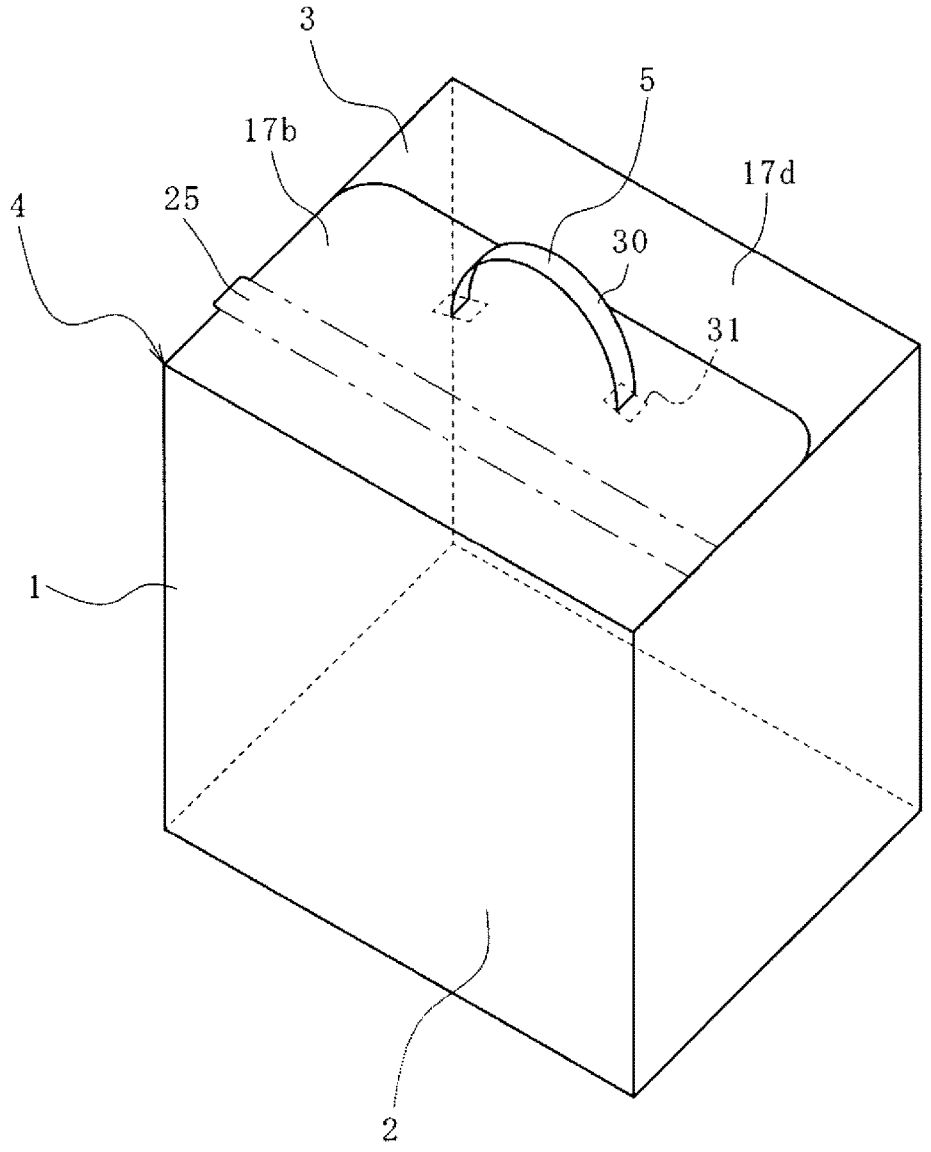
FIG. 1 is a perspective view of a receiving container according to the present embodiment.

FIG. 1 is a perspective view of a receiving container according to the present embodiment. The receiving container includes a container body 4 and a grip member 5. The container body 4 includes a body portion 1, a bottom portion 2 configured to close one end side opening (a bottom surface) of the body portion, and a ceiling portion 3 configured to close another end side opening (a top surface) of the body portion. The grip member 5 is a separate body and is attached to the ceiling portion 3.

Figure 2:
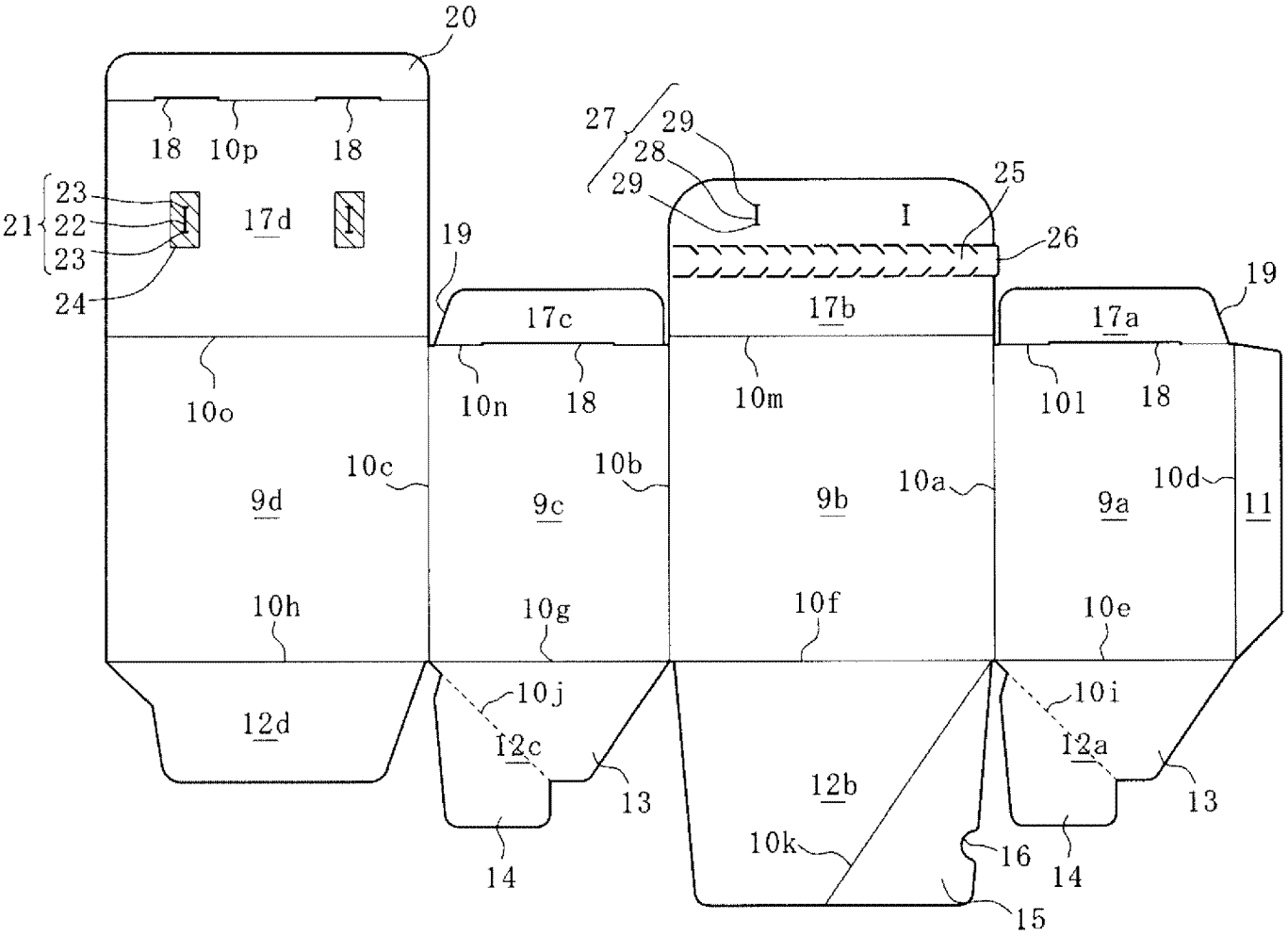
FIG. 2 is a developed view of a corrugated cardboard for forming a container body of the receiving container in FIG. 1.
Figure 3:
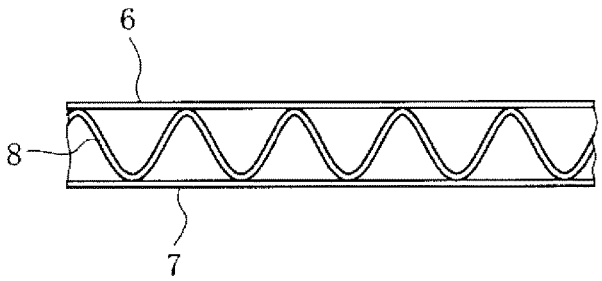
FIG. 3 is a cross-sectional view of the corrugated cardboard in FIG. 2.

The container body 4 is formed by punching corrugated cardboard as a blank shown in FIG. 2 with a well-known paper container punching device (not shown), and by pasting together predetermined portions. As shown in FIG. 3, the corrugated cardboard is a well-known one in which a corrugating medium 8 continuous in a wave shape is disposed between a front liner 6 and a back liner 7. The front liner 6 constitutes an outer surface of the container body 4, and the details of stored articles are printed thereon. The back liner 7 constitutes an inner surface of the container body 4.

As shown in FIG. 2, the body portion 1 of the container body 4 is formed by connecting four side surface portions 9*a*, 9*b*, 9*c*, and 9*d* in series, and boundary portions between the side surface portions 9*a* and 9*b*, between the side surface portions 9*b* and 9*c*, and between the side surface portions 9*c* and 9*d* serve respectively as folding line portions 10*a*, 10*b*, and 10*c*. Groove-shaped ruled lines are formed on an inner side of the bending in the folding line portions 10*a*, 10*b*, and 10*c* (hereinafter, being described as a folding line portion means a structure where such a ruled line is formed to make easier to bend). In addition, a pasting piece 11 serving as a margin for pasting is connected to a side of the side surface portion 9*a* on one end side via the folding line portion 10*d*. Bending the pasting piece 11 at the folding line portion 10*d* to paste on the side surface portion 9*d* of the other end side, and bending at the folding line portions 10*a*, 10*b*, and 10*c* make the side surface portions 9*a*, 9*b*, 9*c*, and 9*d* into a rectangular tubular shape.

The bottom portion 2 of the container body 4 includes bottom surface portions 12*a*, 12*b*, 12*c*, and 12*d* respectively connected to lower sides of the side surface portions 9*a*, 9*b*, 9*c*, and 9*d* via folding line portions 10*e*, 10*f*, 10*g*, and 10*h*. The bottom surface portion 12*a* and the bottom surface portion 12*c* have the same shape and include substantially triangular bottom forming portions 13 and sticking portions 14 extending from one side of the bottom forming portions 13. Boundaries between the bottom forming portions 13 and the sticking portions 14 serve as folding line portions 10*i* and 10*j*, and are mountain-folded in FIG. 2. The bottom surface portion 12*b* has a substantially trapezoidal shape, and a triangular portion 15 is defined by a folding line portion 10*k*. A semicircular notch 16 is formed on a side of the triangular portion 15. Hooking a finger on the notch 16 to pull allows the bottom surface portion 12*b* to be bent at the folding line portion 10*k* and the triangular portion 15 to be raised. The bottom surface portion 12*d* has a substantially trapezoidal shape, and a projecting dimension from a lower side of the side surface portion 9*d* is an approximately half of the bottom surface portion 12*b*. The sticking portion 14 of the bottom surface portion 12*a* is pasted to the portion except the triangular portion 15 of the bottom surface portion 12*b*. The sticking portion 14 of the bottom surface portion 12*c* is pasted to the bottom surface portion 12*d*.

The ceiling portion 3 of the container body 4 includes upper surface portions 17*a*, 17*b*, 17*c*, and 17*d* respectively connected to upper sides of the side surface portions 9*a*, 9*b*, 9*c*, and 9*d* via folding line portions 10*l*, 10*m*, 10*n*, and 10*o*.

The upper surface portions 17*a* and 17*c* are inner flaps (auxiliary extending portions) having the same shape as each other along the folding line portions 10*l* and 10*n* serving as boundaries with the side surface portions 9*a* and 9*c*. A slit 18 is formed slightly above (on a base side of each of the upper surface portions 17*a* and 17*c*) and in a central portion of each of the folding line portions 10*l* and 10*n*. Both end portions of the slits 18 bend to extend to positions of the folding line portions 10*l* and 10*n*. Thus, bending the upper surface portions 17*a* and 17*c* inward at the folding line portions 10*l* and 10*n* causes upper edge portions on the side surface portions 9*a* and 9*c* sides formed with the slits 18 to maintain the upper surface portions 17*a* and 17*c* in an inclined state (hereinafter, portions described as the slits 18 have the same configuration). An inclined portion 19 cut obliquely is formed on one end side (upper surface portion 17*d* side) of each of the upper surface portions 17*a* and 17*c*.

The upper surface portion 17*d* has a substantially rectangular shape in a plan view, and the tip side of a folding line portion 10*p* is a bent portion 20. Both end corner portions of the bent portion 20 are formed in a round shape. The bent portion 20 is inserted into an upper end portion of the side surface portion 9*b* of the body portion 1 in a state bent substantially at a right angle and functions as an inner lid for closing the upper opening portion of the body portion 1. First through holes 21 are formed at a predetermined interval in a central portion of the upper surface portion 17*d*. Each of the first through holes 21 is formed in an I shape in a plan view and includes a first straight portion 22 and second straight portions 23 orthogonal to both ends of the first straight portion 22. The second straight portions 23 are sufficiently shorter than the first straight portion 22 and are provided to facilitate inserting an attachment portion 31 of the grip member 5 to be described below into the first straight portion 22. That is, inserting the attachment portion 31 in the first straight portion 22 causes both side portions of the first straight portion 22 to bend to increase the opening area. The first straight portion 22 is formed to be slightly longer than the width dimension of the attachment portion 31 of the grip member 5. The peripheral region of the first through hole 21 (a rectangular region indicated by oblique lines in FIG. 2) is a thin-walled portion 24 pressed to be thinned. The first through hole 21 and the thin-walled portion 24 can be formed simultaneously with or after punching the corrugated cardboard as a blank. The first through hole 21 is formed in an I shape in a plan view and evenly left and right shape to be punched in a well-balanced manner. Moreover, punching out the first through hole 21 in a state where the thin-walled portion 24 is pressed allows the punched state to be further improved.

The upper surface portion 17*b* has a substantially rectangular shape in a plan view, is formed so as to cover about two thirds, larger than a half, of the upper opening portion of the container body 4, and functions as an upper lid. Both sides of the tip of the upper surface portion 17*b* are formed in a round shape. The upper surface portion 17*b* is made so that the tip side half can be separated with a separation portion 25. The separation portion 25 has perforations formed in two rows, and one end side of the separation portion 25 is a tab 26 protruding from the side of the upper surface portion 17*b*. Grabbing and pulling the tab 26 allows the separation portion 25 to be separated along the perforations and the upper surface portion 17*b* to be separated into a tip side and a base side. In addition, in the upper surface portion 17*b*, second through holes 27 are formed in the respective positions, to be cut off with the separation portion 25, corresponding to the first through holes 21. The configuration of each of the second through hole 27 is substantially the same as that of the first through hole 21, but the length of a first straight portion 28 is shorter than the length of the first through hole 21 and is set to the minimum necessary value that the attachment portion 31 of the grip member 5 can be inserted. It should be noted that the length of a second straight portion 29 is the same as that of the second straight portion 23.

Figure 6:
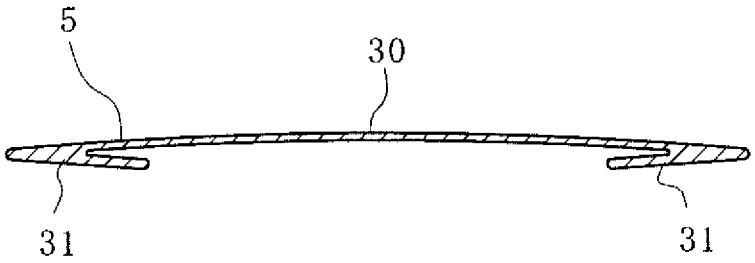
FIG. 6 is a cross-sectional view of a grip member shown in FIG. 1.

The grip member 5 is obtained by forming of synthetic resin material, and as shown in FIG. 6, includes a grip portion 30 and the attachment portions 31 provided at both end portions of the grip portion 30.

The grip portion 30 extends in a band shape with a constant width and is configured to curve in an arc shape when gripped by hand as will be described below.

The attachment portions 31 are formed in a flat plate shape in which those central portions are integrated with both ends of the grip portion 30. The attachment portion 31 has substantially the same width dimension as that of the grip portion 30, and is along the grip portion 30 in a normal state. The attachment portions 31 are inserted through the first through holes 21 of the upper surface portion 17*d*, whereby both end portions of the attachment portions 31 abut on both side portions constituting the first through holes 21 to be prevented from coming off.

The receiving container having the above configuration is assembled as follows.

Figure 4:
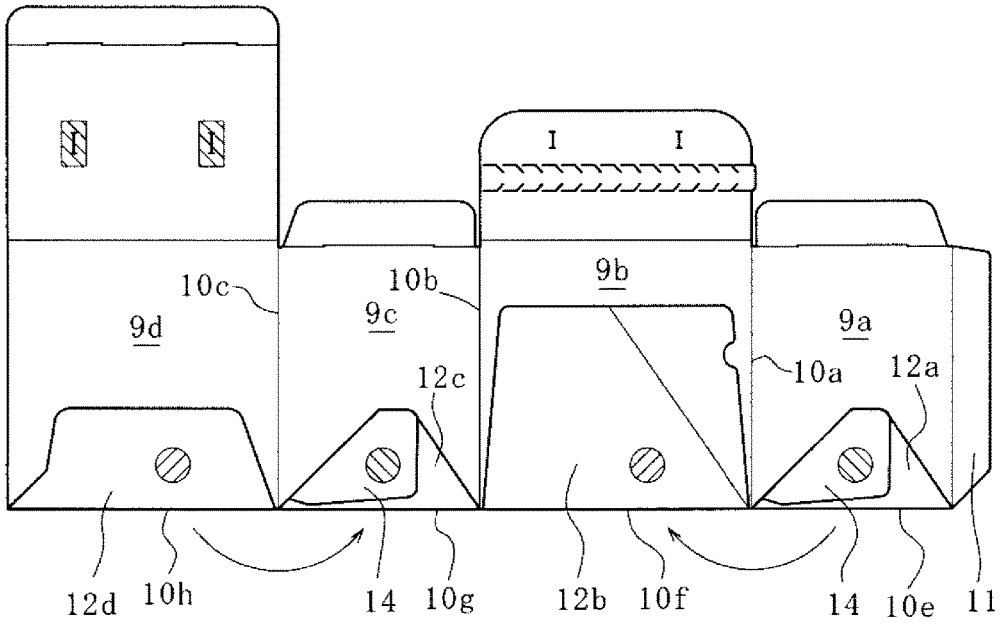
FIG. 4 is a view showing a state where a bottom surface portion is bent from the state shown in FIG. 2.
Figure 5:
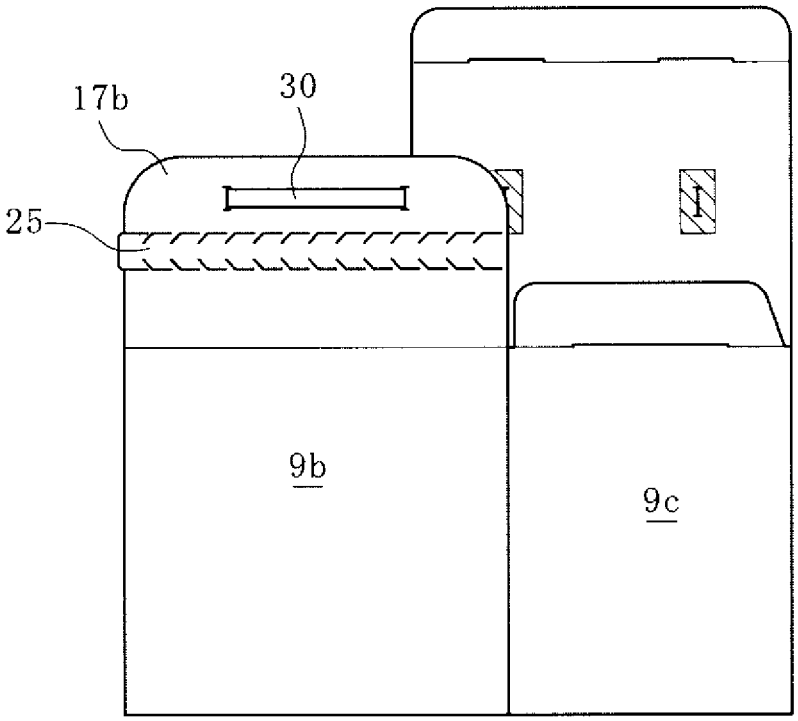
FIG. 5 is a view showing a state where side surface portions on both sides are bent from the state shown in FIG. 4.

That is, as shown in FIG. 4, the bottom surface portions 12*a*, 12*b*, 12*c*, and 12*d* are respectively bent inward at the folding line portions 10*e*, 10*f*, 10*g*, and 10*h* from the state of being punched out as one blank shown in FIG. 2. At this time, the sticking portion 14 of each of the bottom surface portions 12*a* and 12*c* is bent beforehand. Then, as indicated by arrows, the side surface portions 9*a* and 9*d* are bent inward. At this time, the sticking portion 14 of the bottom surface portion 12*a* is pasted to the bottom surface portion 12*b*, and the sticking portion 14 of the bottom surface portion 12*c* is pasted to the bottom surface portion 12*d* (in the figure, the pasted parts are indicated by hatched circles). In addition, the pasting piece 11 of the side surface portion 9*a* is pasted to the side surface portion 9*d*. Furthermore, inserting each of the attachment portions 31 of the grip member 5 into a corresponding one of the second through holes 27 of the upper surface portion 17*b* to attach the grip member 5 causes the state shown in FIG. 5 to be obtained.

Figure 7:
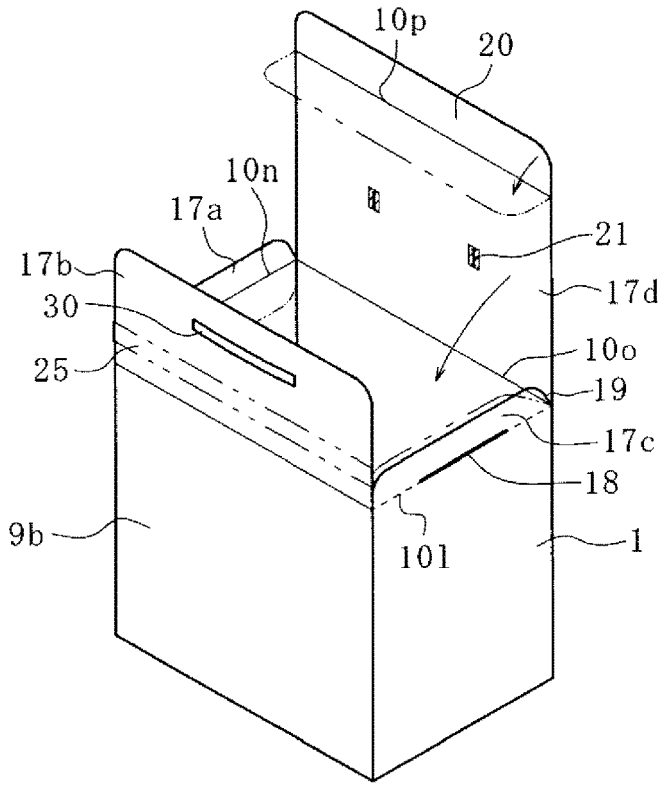
FIG. 7 is a perspective view showing a state where a body portion is formed by forming the side surface portions into a rectangular tubular shape from the state shown in FIG. 5.

In the receiving container thus assembled, bending the folding line portions 10*a*, 10*b*, and 10*c* to form the side surface portions 9*a*, 9*b*, 9*c*, and 9*d* into the rectangular tubular body portion 1 and bending back the bottom surface portions 12 inward to form the flat bottom portion 2 cause a box shape with an opening at the top as shown in FIG. 7 to be obtained. In this state, the upper surface portions 17*a*, 17*b*, 17*c*, and 17*d* protrude upward from the side surface portions 9 respectively in the same plane. Therefore, a plurality of receiving containers can be arranged side by side without any gap. For example, the plurality of receiving containers can be collectively arranged in a large-sized box with the top of the receiving container being opened.

Figure 8:
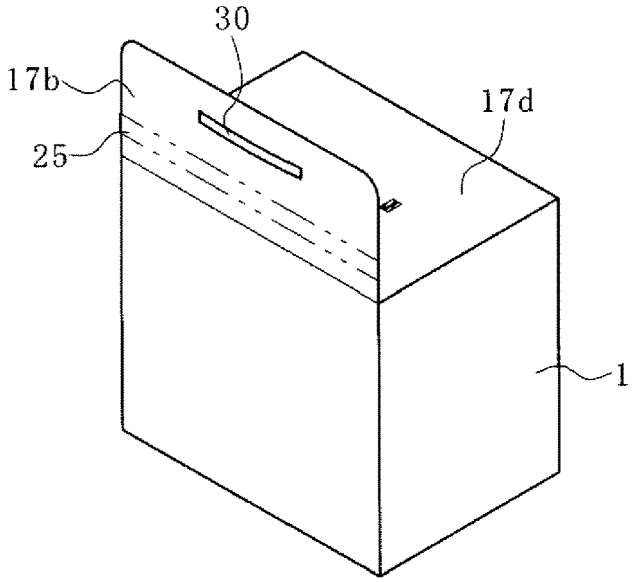
FIG. 8 is a perspective view showing a state where an upper opening portion of the body portion is closed by bending the upper surface portion from the state shown in FIG. 7.

Poultices, food, and the like can be stored in the receiving container from above. When the storage work is completed, the upper surface portions 17*a* and 17*c* are bent inward. The upper surface portions 17*a* and 17*c* are maintained in an inclined state as shown by a two-dot chain line in FIG. 7 by merely being pushed inward with the formed ruled line and the slit 18. Then, when the upper surface portion 17*d* is being bent inward, the upper surface portions 17*a* and 17*c* are further bent inward while being pressed by the inclined portion 19 on one end side. The bent portion at the tip of the upper surface portion 17*d* is bent to be inserted into the upper opening portion of the body portion 1 (along the inner surface of the side surface portion 9*b*). Since the upper surface portions 17*a* and 17*c* are inclined in advance and the inclined portion 19 is formed on one end side thereof, the upper opening portion of the body portion 1 can be closed smoothly as shown in FIG. 8 while the upper surface portions 17*a* and 17*c* are bent due to the bending of the upper surface portion 17*d*. In this state, the upper surface portions 17*a* and 17*c* prevent the upper surface portion 17*d* from falling into the body portion 1 and restrict the access from the side to the inside.

After the upper opening portion of the body portion 1 is closed with the upper surface portion 17*d*, the upper surface portion 17*b* is bent. In this case, the attachment portions 31 of the grip member 5 previously attached to the upper surface portion 17*b* are inserted into the first through holes 21 of the upper surface portion 17*b*. The first through hole 21 includes a first straight portion 22 and second straight portions 23 at both ends of the first straight portion 22, and the length of the first straight portion 22 is formed slightly larger than the width dimension of the attachment portion 31 to be inserted. Moreover, the periphery of the first through hole 21 includes the thin-walled portion 24. Therefore, even when the upper surface portion 17*b* is folded over the upper surface portion 17*d* and the first through holes 21 are difficult to visually recognize, the attachment portion 31 can be smoothly inserted into the first through hole 21 without entering between the front liner 6 and the back liner 7 of the corrugated cardboard. Then, the attachment portions 31 abut on the inner surfaces on both sides constituting the first through holes 21 to be prevented from coming off.

In the receiving container thus assembled, as shown in FIG. 1, the upper opening portion of the body portion 1 is closed with the upper surface portion 17*d*. Then, the upper surface portion 17*d* is connected to the upper surface portion 17*b* with the grip member 5. Therefore, unless the separation portion 25 is separated, the stored articles cannot be taken out. In addition, gripping the grip portion 30 of the grip member 5 allows the receiving container to be easily carried with one hand. In this case, the grip member 5 is attached to both of the upper surface portions 17*d* and 17*b*. For this reason, although the separation portion 25 is formed in the upper surface portion 17*b*, the receiving container has sufficient strength, and even if the stored articles in the receiving container are heavy, the stored articles can be carried without anxiety.

When the stored articles are to be taken out from the receiving container, the upper surface portion 17*d* only has to be opened by separating the separation portion 25. Unless the separation portion 25 is to be separated, the receiving container cannot be opened, so that the opening by a third party can be left as a trace. In addition, even after the separation portion 25 is cut off, the upper opening portion of the body portion 1 can be closed with the upper surface portion 17*d*.

After all the stored articles are taken out, the triangular portion 15 constituting the bottom surface portion 12*b* is lifted by a finger being hooked on the notch 16. Then, the bottom surface portions 12*a*, 12*b*, 12*c*, and 12*d* are bent to be raised. Thus, after use, the receiving container can be easily folded in a state of overlapping the side surface portions 9*a* and 9*d* with the side surface portions 9*b* and 9*c*.

It should be noted that the present invention is not limited to the configuration described in the above embodiment, and various modifications are possible.

In the above embodiment, the container body 4 is formed of a corrugated cardboard, but is not limited thereto, and may be made of other materials such as thick paper and plastic thin plate, or other structures.

In the above embodiment, the container body 4 is formed in a rectangular parallelepiped shape in the assembled state, but is not limited thereto, and other shapes such as a polygonal or circular tubular shape may be used. In addition, the ceiling surface is configured to be planar, but other shapes such as a mountain shape may be used.

In the above embodiment, the attachment portions 31 of the grip member 5 is configured to have a plate shape continuous to both end portions of the grip portion 30, but are not limited thereto, and for example, may be configured to spread in an umbrella shape. In short, any configuration can be adopted as long as the attachment portions 31 of the grip member 5 can be attached to both of the upper surface portions 17*b* and 17*d* of the container body 4. In addition, the attachment portion 31 is not limited to a configuration in which the attachment portion 31 is attached to the first through hole 21, and may be fixed with an adhesive or the like.

In the above embodiment, the first through holes 21 and the second through holes 27 are provided at two places, but they may be provided at one place or at three or more places. In addition, these through holes 21 and 27 have a configuration in which the second straight portions 23 are orthogonal to both end portions of the first straight portion 22, but are not limited thereto, and only have to have a configuration in which inserting the attachment portion 31 of the grip member 5 into the through holes 21 or 27 is facilitated by forming the second straight portion 23 intersecting with the first straight portion 22 at at least one place.

In the above embodiment, the separation portion 25 is configured to have two rows of perforations, but may simply have only one row of perforations. The separation portion 25 can be provided at any place such as along the folding line portion 10m. However, providing the separation portion 25 at the position shown in FIG. 2 makes it difficult to separate easily even when, for example, the grip member 5 is grabbed to be carried. In addition, the separation portion 25 may be formed in the upper surface portion 17*d*.

Figure 9:
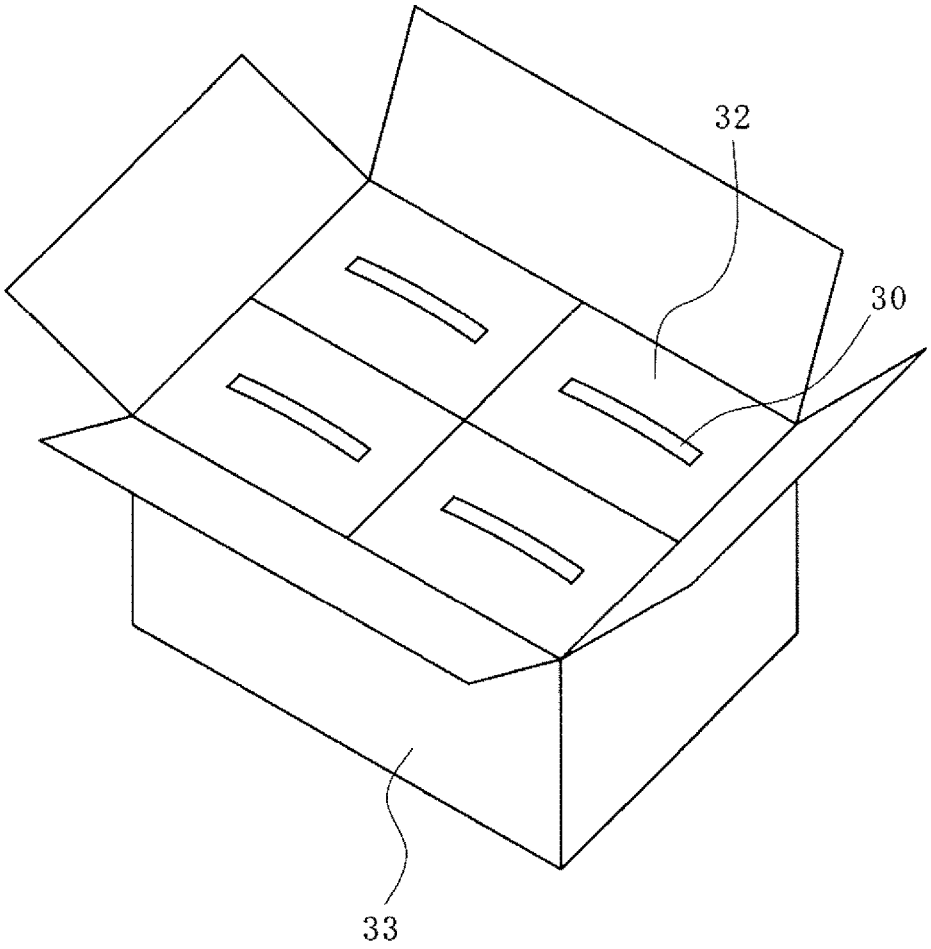
FIG. 9 is a perspective view showing a state where four receiving containers shown in FIG. 1 are stored in a large-sized container.

In the above embodiment, the case of storing stored articles in the receiving container is described, but furthermore, it is also possible to store a plurality of the receiving containers together in another large-sized container. For example, as shown in FIG. 9, four receiving containers 32 can be accommodated in a large-sized container 33 in two rows and two columns.

In this case, if each of the receiving containers 32 is not provided with the grip portion 30, it is necessary to hold and lift the receiving containers 32 with fingers inserted between the adjacent receiving containers 32 and between the receiving containers 32 and the large-sized container 33, and this take-out work is very difficult. In contrast, since the receiving container 32 is provided with the grip portion 30, the receiving container 32 can be easily taken out of the large-sized container 33 only by gripping and pulling up the grip portion 30. In addition, when the receiving containers 32 are taken out of the large-sized container 33, since the receiving containers 32 are accommodated without any gap, the frictional force between the receiving containers 32 or between the receiving containers 32 and the large-sized container 33 is large. In addition, there is also an influence of the weight of stored articles stored in the receiving container 32. Therefore, a large load acts on the grip portion 30. However, the grip portion 30 is attached to both of the upper surface portions 17*b* and 17*d*, thus having sufficient strength. Therefore, it is unlikely that the load is concentrated and the receiving container 32 is damaged as compared with the case where the connecting portion of the grip portion 30 to the receiving container 32 is positioned in only one upper surface portion.

DESCRIPTION OF REFERENCE SIGNS

1: Body portion
2: Bottom portion
3: Ceiling portion
4: Container body
5: Grip member
6: Front liner
7: Back liner
8: Corrugating medium
9*a* to 9*d:* Side surface portion
10*a* to 10*p:* Folding line portion
11: Pasting piece
12*a* to 12*d:* Bottom surface portion
13: Bottom forming portion
14: Sticking portion
15: Triangular portion
16: Notch
17*a*, 17*c:* Upper surface portion (auxiliary extending portion)
17*b:* Upper surface portion (second extending portion)
17*d:* Upper surface portion (first extending portion)
18: Slit
19: Inclined portion
20: Bent portion
21: First through hole
22: First straight portion
23: Second straight portion
24: Thin-walled portion
25: Separation portion
26: Tab
27: Second through hole
28: First straight portion
29: Second straight portion
30: Grip portion
31: Attachment portion
32: Receiving container
33: Large-sized container

The invention claimed is:

1. A receiving container comprising:

(a) a container body including:

a body portion having a hollow tubular shape;

a bottom portion configured to close a first end side opening portion of the body portion; and a ceiling portion configured to close a second end side opening portion of the body portion, the ceiling portion having a first extending portion and a second extending portion, each of the first extending portion and the second extending portion extending from an edge of the second end side opening portion and one of the first extending portion and the second extending portion having a separation portion configured to separate a tip portion; and (b) a grip member including:

attachment portions attached to the first extending portion and the second extending portion, the attachment portions being configured to prevent the first extending portion and the second extending portion from opening from the second end side opening portion, and are attached to a tip side of the separation portion in the first extending portion or the second extending portion provided with the separation portion; and a grip portion grippable by hand;

wherein first through holes are formed in the first extending portion, wherein second through holes are formed in the second extending portion at positions corresponding to the first through holes with the second extending portion overlapping with the first extending portion on an outer surface side, wherein the attachment portions are inserted in the first through holes via the second through holes to prevent the attachment portions from coming off, wherein the second end side opening portion of the body portion has a rectangular shape, wherein the first extending portion is an inner lid extending from a first side of a pair of opposite sides in the second end side opening portion and configured to close the second end side opening portion, wherein the second extending portion is an upper lid extending from a second side of the pair of opposite sides in the second end side opening portion and configured to cover at least a part of the first extending portion, wherein the container body is made of corrugated cardboard, and wherein, in the first extending portion, predetermined regions including the first through holes have thin-walled portions thinner than other portions.

2. The receiving container according to claim 1, wherein the first through holes include first straight portions formed in parallel at a predetermined interval and second straight portions formed to intersect the respective first straight portions, and wherein the attachment portions extend from both end portions of the grip portion to both sides, and are inserted in the first straight portions of the first through holes to prevent the attachment portions from coming off.

3. The receiving container according to claim 2, wherein the container body includes auxiliary extending portions extending from sides of a remaining pair of the opposite sides in the second end side opening portion.

4. The receiving container according to claim 1, wherein the auxiliary extending portions are connected to the container body via a folding line portion, the auxiliary extending portions bend at a predetermined angle to the container body by the folding line portion when a bending force acts toward inside, and bend to a closing position when the second end side opening portion of the container body is closed with the first extending portion.

5. The receiving container according to claim 1, wherein the container body includes auxiliary extending portions extending from sides of a remaining pair of the opposite sides in the second end side opening portion.

6. The receiving container according to claim 5, wherein the auxiliary extending portions are connected to the container body via a folding line portion, the auxiliary extending portions bend at a predetermined angle to the container body by the folding line portion when a bending force acts toward inside, and bend to a closing position when the second end side opening portion of the container body is closed with the first extending portion.

* * * * *